US006831242B1

(12) United States Patent
Ni

(10) Patent No.: US 6,831,242 B1
(45) Date of Patent: Dec. 14, 2004

(54) PUSH SWITCH DEVICE

(75) Inventor: Yu-Ting Ni, Hsin-Tien (TW)

(73) Assignee: Shin Jiuh Corp., Taipei Hsien (TW)

( * ) Notice: Subject to any disclaimer, the term of this patent is extended or adjusted under 35 U.S.C. 154(b) by 0 days.

(21) Appl. No.: 10/164,371

(22) Filed: Jun. 10, 2002

(51) Int. Cl.[7] ..... H01H 13/52
(52) U.S. Cl. ..... 200/521; 200/533
(58) Field of Search ..... 200/521, 534, 200/535, 533, 341, 345

(56) References Cited

U.S. PATENT DOCUMENTS 3,287,513 A * 11/1966 McFarland ..... 200/521
5,912,445 A * 6/1999 Takedomi ..... 200/534
6,018,132 A * 1/2000 Chen ..... 200/533
6,441,331 B1 8/2002 Ni et al. ..... 200/534

* cited by examiner

*Primary Examiner*—Renee Luebke
(74) *Attorney, Agent, or Firm*—Birch, Stewart, Kolasch & Birch, LLP

(57) ABSTRACT

A push switch device of the invention comprises a body including a set of terminals and closed via a cover. An inner side of the cover is provided with a second resilient unit on which is formed a stopper portion. A push unit is further formed through the body, the push unit being provided with a stop controller pad made of an abrasion-resistant material that is vis-à-vis the stopper portion. A first resilient unit is further placed below the push unit. With the above disposition, when a pressure is exerted on the push unit, the stop controller pad pushes on the stopper portion that moves outwardly. Thereby damage due to wear of the push unit is prevented.

12 Claims, 7 Drawing Sheets

PUSH SWITCH DEVICE

FIELD OF THE INVENTION

The invention relates to a structure of push switch device and, more particularly, to a structure that can enhance the service life of the push switch device.

BACKGROUND OF THE INVENTION

FIG. 1 is an exploded view that schematically illustrates a structure of push switch device disclosed in a previous U.S. patent application Ser. No. 09/740,997, now U.S. Pat. No. 6,441,331, filed by the same applicant as the present application. As illustrated, the push switch device of the prior art, used to signal connection or output, comprises a body on which two terminals are mounted. A first resilient unit is further arranged within the body, below a push unit. A cover further closes the cover. Under the application of an external pressure therein, the push unit drives a displacement of the second resilient unit to push on the first resilient unit. Under the application of an external pressure thereon, the push unit drives a displacement of the second resilient unit to push on the first resilient unit. Under this down pushing action, the first resilient unit establishes electrical contact with two terminals, thereby establishing an electrical output. When no pressure is exerted on the push unit, the first and second resilient units exert a reverse resilient force that lets the push unit recover its initial position.

Although the above structure is simpler than traditional structures of push switch device and has less contact points, which reduces the electric resistance and prevents signal deterioration, but improvements still need to be accomplished with respect to the disposition of the resilient units.

Therefore, the same applicant has disclosed another structure of push switch device in another application, as also illustrated in FIG. 2. As shown in FIG. 2, this structure includes a body, two terminals disposed on the body, a resilient unit arranged within the body, a push unit arranged above the resilient unit within the body, and a cover closing over the body. The above structure, suitable for signal connection and output, is characterized in that the resilient unit is comprised of an actuating portion that extends into support portions at two ends, these support portions being disposed within the body. Furthermore, the push unit is provided with a recess to receive the actuating portion of the resilient unit. With this disposition, when the push unit is pushed down, an inner radius of the actuating portion contracts, which causes the support portions to be pushed down and electrically contact with the terminals, thereby establishing a signal connection. When no external pressure is exerted on the push unit, the resilient unit exerts a reverse resilient force that let the push unit recover its initial position.

The second structure of push switch device as illustrated in FIG. 2 provides a simpler and more achieved construction in comparison with the first structure as illustrated in FIG. 1. However, both structures still have the following disadvantages. The feeling of push contact the user have when pushing and the accompanying sound are produced via the contact between a recess of the push unit and the corresponding second resilient unit and protruding point formed on the cover. The push unit being usually made of plastics and the cover of metal, a pushing action on the push unit therefore easily causes the protruding point of the metallic cover to scrape the plastics-made push unit. With numerous pushing actions, the scrape on the push unit becomes increasingly deeper until it is deeper than the length of the protruding point of the cover. As a result, no push contact feeling and corresponding sound are therefore produced, which negatively reduces the service life of these elements.

SUMMARY OF THE INVENTION

Accordingly, it is therefore a principal object of the invention to provide a structure of switch device that can overcome the above problems of push unit wear off due to scraping effects for producing a push contact feeling and corresponding sound. Thereby, the service life of the switch device and its quality are enhanced.

To attain the above and other objectives, a push switch device of the invention comprises a body including a set of terminals, a periphery of the body being further provided with a first assembly element. A cover includes a second assembly element that assembles with the first assembly element of the body in a manner to close the body. An inner side of the cover is provided with a second resilient unit on which is formed a stopper portion. A push unit is further formed through the body, the push unit being provided with a stop controller pad made of an abrasion-resistant material that faces the stopper portion. A first resilient unit is further placed below the push unit.

With the above disposition, when a pressure is exerted on the push unit, the stop controller pad pushes on the stopper portion that moves outwardly. Thereby a wearing damageable contact of the stopper portion with the push unit is prevented, meanwhile the first and second assembly elements enable a rapid and simple assembly of the body with the cover.

To provide a further understanding of the invention, the following detailed description illustrates embodiments and examples of the invention, this detailed description being provided only for illustration of the invention.

BRIEF DESCRIPTION OF THE DRAWINGS

The drawings included herein, which are given by way of illustration only, and thus are not limitative of the present invention, provide a further understanding of the invention. A brief introduction of the drawings is as follows.

DETAILED DESCRIPTION OF THE EMBODIMENTS

Figure 1:
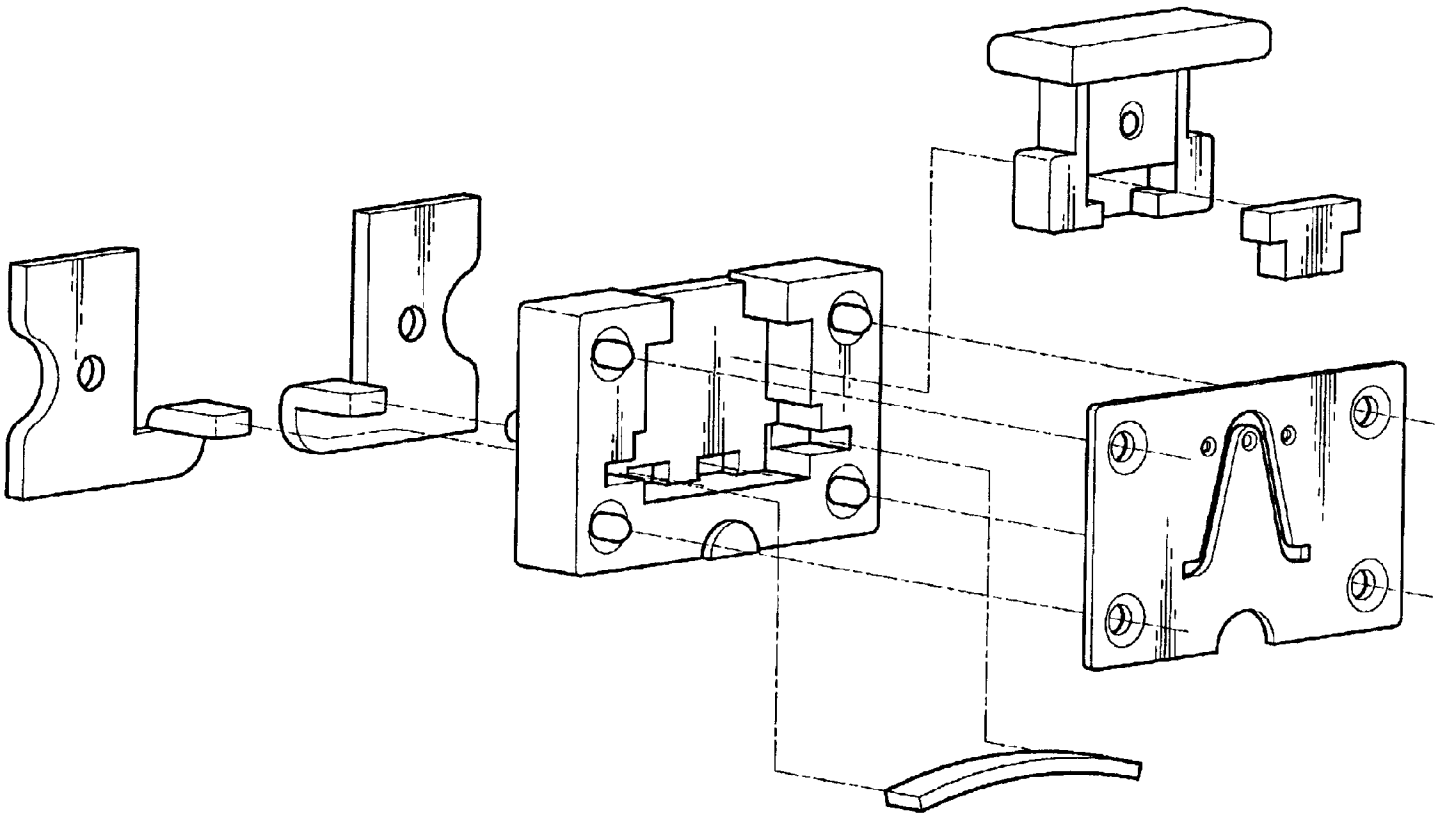
Fig.1 PRIOR ART
FIG. 1 is an exploded view of a structure of push device of the prior art.
Figure 2:
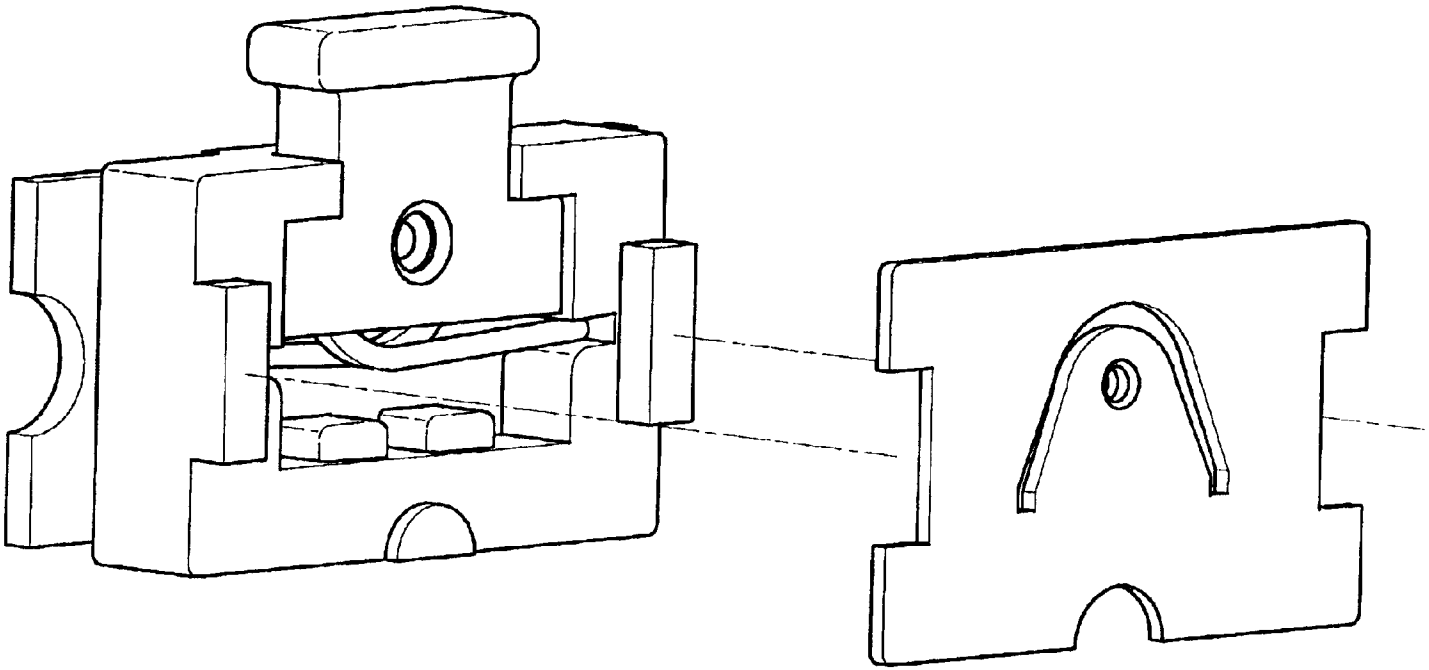
Fig.2 PRIOR ART
FIG. 2 is an exploded view of another structure of push switch device of the prior art.

Wherever possible in the following description, like reference numerals will refer to like elements and parts unless otherwise illustrated.

Figure 3:
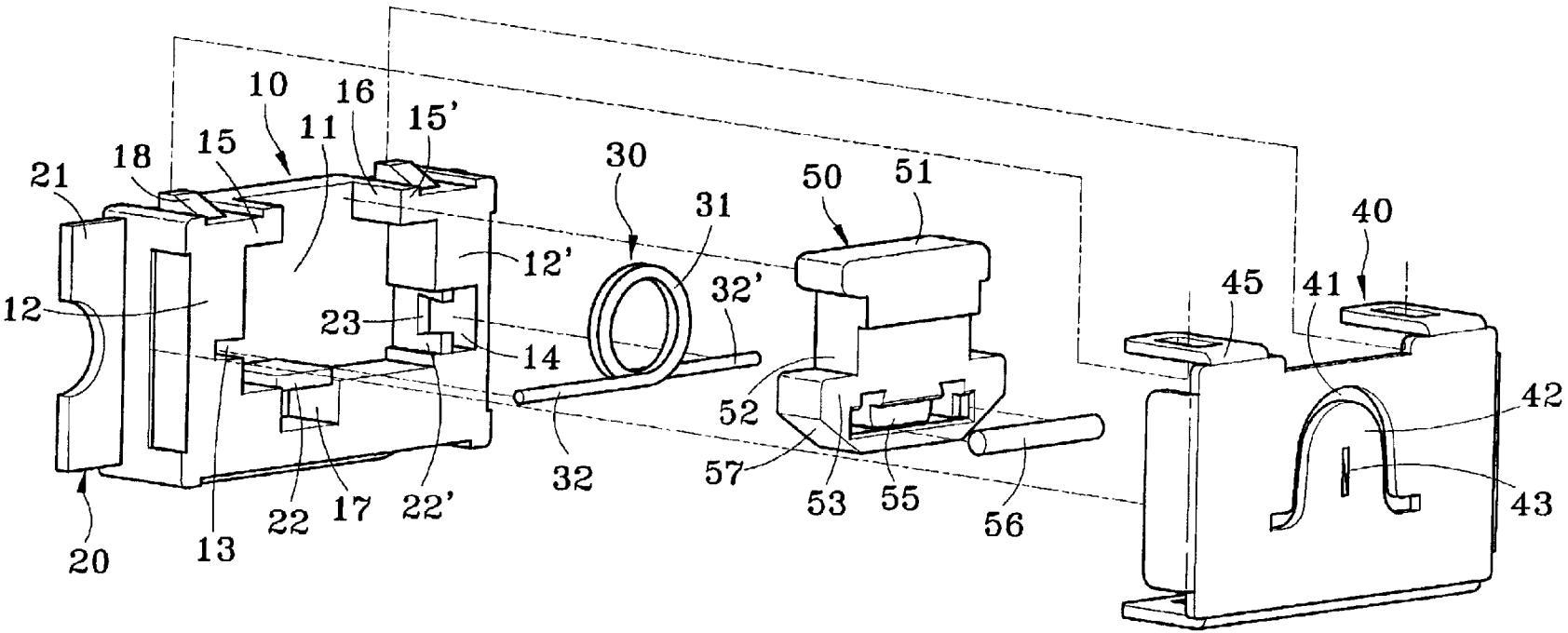
FIG. 3 is an exploded view of a structure of push switch device according to an embodiment of the invention.
Figure 4:
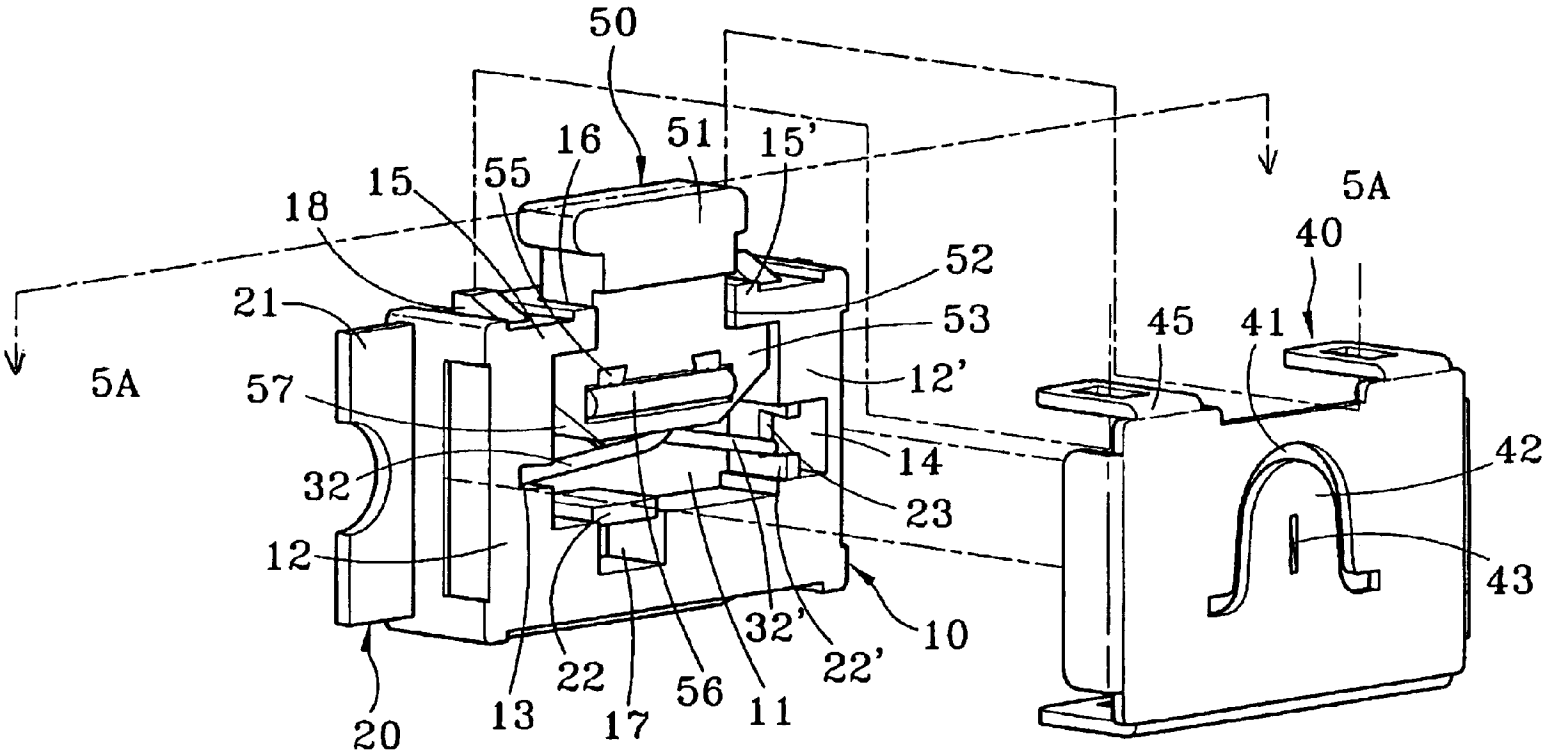
FIG. 4 is an exploded view of the push switch device without the cover according to an embodiment of the invention.
Figure 7:
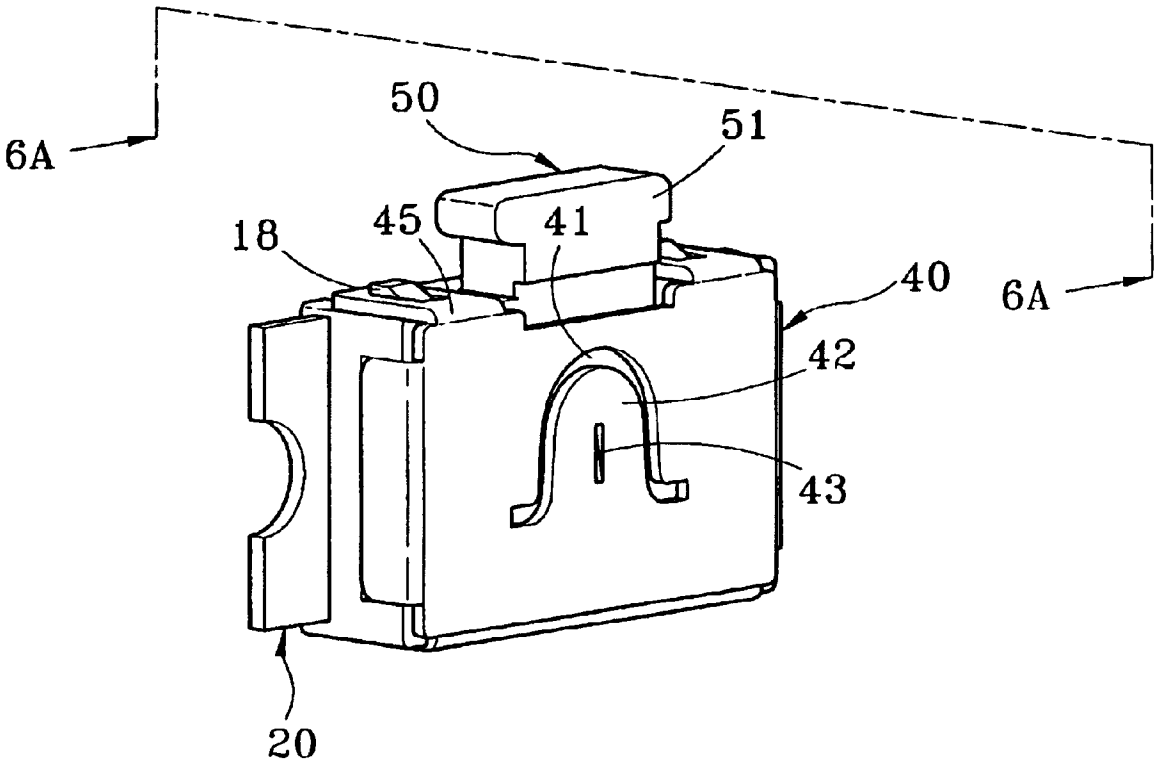
FIG. 7 is an assembled view of the push switch of the present invention.

FIG. 3 is a general exploded view of a push switch device according to an embodiment of the invention. FIG. 4 is an exploded view of the push switch device of the invention without the cover 40. FIG. 7 is an assembled view of the push switch device of the invention. As illustrated, a push switch device of the invention respectively comprises the assembly of a body 10 with a cover 40, a set of terminals 20, 20' mounted on the body 10, a push unit 50 disposed within the body 10 with a portion exposed out of the body 10, and a first resilient unit 30 mounted below the push unit 50 so as to exert a resilient force for re-positioning the push unit 50. From the above elements, a push switch device for signals switching or output is constructed.

The body 10 internally defines a displacement space 11 at two sides of which are formed protruding portions 12, 12'. At a top end, the protruding portions 12, 12' respectively extend in abutments 15, 15' that define an opening 16 communicating with the displacement space 11. At one side, a sidewall of one protruding portion 12 includes a first engagement slot 13 that enables the mount of the first resilient unit 30. On a sidewall of the other protruding portion 12' and on a bottom surface of the displacement space 11 are further respectively formed first and second mounting slots 14, 17.

The terminals 20, 20' respectively include segments 21, 21' on which are respectively erected connecting sections 22, 22' for electrical signals transmission. To simplify the fabrication process and reduce the fabrication time and process sequence, the terminals 20, 20' are directly buried within the body 10 when the body 10 is formed. More particularly, the terminals 20, 20' are placed within 20 the body 10 in a manner that one connecting section 22 is disposed in the second mounting slot 17 while the other connecting section 22' is placed on the first mounting slot 14 of the protruding portion 12'. The connecting section 22' is further provided with a second engagement slot 23 for mounting the first resilient unit 30.

The first resilient unit 30 can be, for example, a metallic torsion spring that is principally comprised of a loop resilient portion 31 extending into support portions 32, 32' at two ends. The support portions 32, 32' are placed over the body 10 in a manner to engage the first engagement slot 13 and the second engagement slot 23 of the terminal 20'. Hence, when the first resilient unit 30 is subject to a pressure, an inner radius of the loop resilient portion 31 is slightly contracted. Under a resulting pressure, the support portions 32, 32' are pushed down so as to contact with the connecting sections 22, 22'. The displacement of the first resilient unit 30 thereby achieves the switching operation to contact with the connecting sections 22, 22', thereby allowing signal transmission through the terminals 20, 20'.

The push unit 50 includes a push head 51 that downwardly extends through a neck portion 52 into a protrusion 53. A side of the protrusion 53 is provided with a connecting slot 54 that enables the mount of the loop resilient portion 31. Another side of the protrusion 53 facing a side of the cover 40 is further provided with a recess 55 in which is placed a stop controller pad 56 made of an abrasion-resistant material. Furthermore, two sides of the protrusion 53 are formed into oblique faces 57 that enable the displacement of the first resilient unit 30 and consequently, the move of the support portions 32, 32' of the first resilient unit 30.

The cover 40 is made of a metallic material and is provided with a second resilient unit 42 on which is arranged a stopper portion 44 facing the stop controller pad 56. Thereby, when the push unit 50 moves downward, the stop controller pad 56 pushes the stopper portion 44 to produce a push contact feeling. Furthermore, when the push unit 50 moves upward to be re-positioned, the second resilient unit 42 of the cover 40 pushed the push unit 50, thereby producing a sound. The second resilient unit 42 can be formed from, for example, an arcuate cut slot 41 directly formed through the cover 40. The stopper portion 44 can be, for example, a second groove 43 directly formed through the second resilient unit 42. The body 10 and the cover 40 are further provided with assembly elements 18, 45 that mount with each other.

Figure 5A:
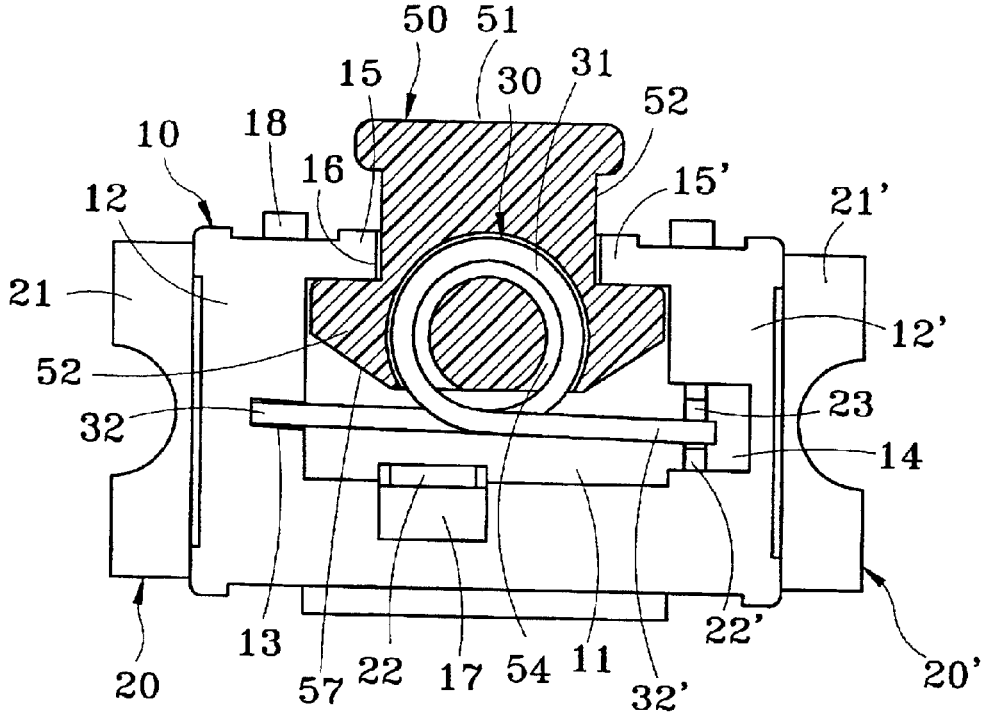
FIG. 5A is a section view taken along the section 5A in FIG. 4.
Figure 5B:
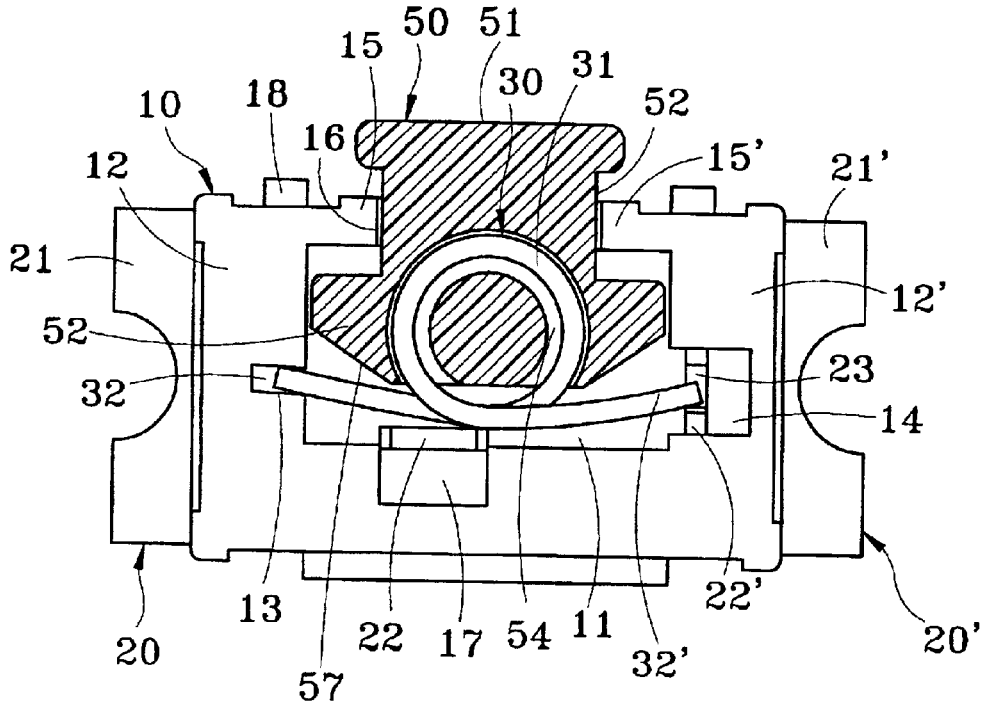
FIG. 5B is a schematic view illustrating a displacement with respect to the configuration shown in FIG. 5A.

Referring to FIG. 5A and FIG. 5B, when the push head 51 of the push unit 50 is subject to an external pressure, the neck portion 52 slides along the opening 16 of the body 10 and the push unit 50 hence pushes on the first resilient unit 30. Because one respective side of each support portion 32, 32' is originally permanently connected to one connecting section 22, 22' placed in the first and second mounting slots 14, 17, the push on the first resilient unit 30 produces a contraction thereof. As a result, one respective second side of each support portion 32, 32' to electrically contact with the connecting sections 22, 22' placed in the second mounting slot 17, thereby producing an electrical output. When the push head 51 no longer receives an external pressure thereon, the push unit 50 is subject to a resilient force from the first resilient unit 30 and consequently recovers its initial position.

Figure 6A:
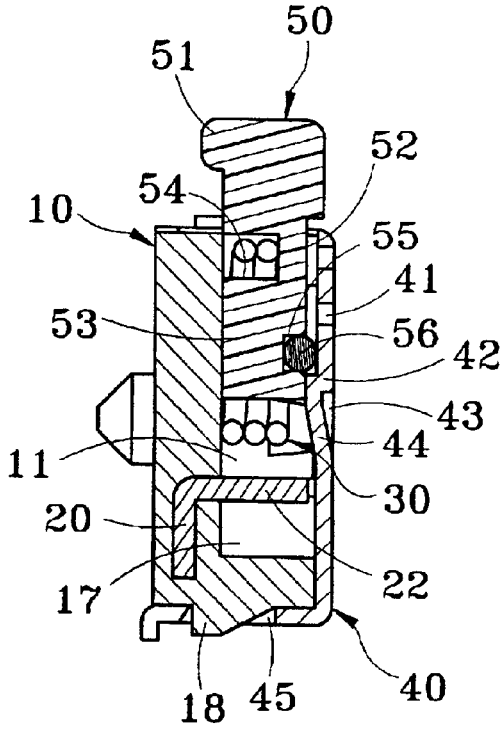
FIG. 6A is a section view taken along the section 6A in FIG. 7.
Figure 6B:
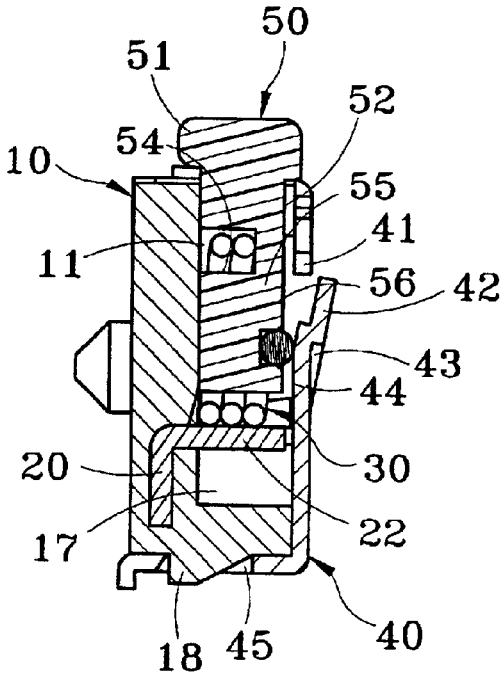
FIG. 6B is a schematic view illustrating a displacement with respect to the configuration shown in FIG. 6A.

Referring to FIG. 6A and FIG. 6B, when the push unit 50 is pushed down, the stop controller pad 56 pushes on the stopper portion 44 to produce a push contact feeling while the second resilient unit 42 of the cover 40 produces a revere resilient force. Hence, a direct damageable contact of the stopper portion 44 with the push unit 50, which may wear away the surface of the protrusion 53, is thereby prevented. When the external pressure is released, the stopper portion 44 is subject to the reverse force from second resilient unit 42 to recover its initial position and, consequently, pushes the surface of the protrusion 53, which produces a sound. Thereby, the effective switching action of the switch can be felt once the push action is stopped.

It should be apparent to those skilled in the art that the above description is only illustrative of specific embodiments and is examples of the invention. The invention should therefore cover various modifications and variations made to the herein-described structure and operations of the invention, provided they fall within the scope of the invention as defined in the following appended claims.

What is claimed is:

1. A push switch device, comprising:

a body, including a set of terminals, a periphery of the body being further provided with a first assembly element;

a cover, including a second assembly element facing the first assembly element of the body, an inner side of the cover being further provided with a second resilient unit on which is formed a stopper portion, the second resilient unit being formed from an arcuate slot cut through the cover;

a push unit positioned in the body, the push unit being provided with a stop controller pad made of an abrasion-resistant material that faces the stopper portion; and a first resilient unit;

wherein when pressure is exerted on the push unit, the stop controller pad pushes the stopper portion outwardly, thereby avoiding damage due to wear of the push unit, the first and second assembly elements enable a rapid and simple assembly of the body with the cover and wherein two sides of the push unit are formed into oblique faces that enable movement of the first resilient unit.

2. The structure of claim 1, wherein the push unit is further provided with a recess arranged opposite the stop controller pad.

3. The structure of claim 1, wherein the stop controller pad is made of metallic material.

4. The structure of claim 1, wherein the cover is made of metallic material, and the stopper portion is formed at a groove formed in the second resilient unit.

5. The structure of claim 1, wherein the stopper portion and the second resilient unit form a notch for receiving the stop controller pad before and after pressure is exerted on the push unit, the stop controller pad being moved from the notch when pressure is exerted on the push unit to move the stopper portion outwardly.

6. The structure of claim 1, wherein the set of terminals includes a first terminal and a second terminal, the first resilient unit being in contact with the first terminal and also being movable into contact with the second terminal when the push unit is moved.

7. The structure of claim 6, wherein the stop controller pad pushes on the stopper portion when the push unit is moved and whereafter upon release of pressure exerted on the push unit, the push unit is urged by the first resilient unit back to a home position whereat the stop controller pad stops pushing the stopper portion outwardly.

8. The structure of claim 7, wherein the first resilient unit continues to engage the first terminal but fails to engage the second terminal when the push unit is in the home position.

9. The structure of claim 6, wherein the first resilient unit is a torsion spring.

10. The structure of claim 6, wherein the first terminal is to a side of the first resilient unit and wherein the second terminal is below the first resilient unit, the first resilient unit being between the push unit and the second terminal.

11. The structure of claim 1, wherein a side of the push unit has an annular opening for receiving a portion of the first resilient unit.

12. The structure of claim 1, wherein the second resilient unit and the cover are a one-piece structure.

* * * * *